US006876333B2

(12) United States Patent
Tasi

(10) Patent No.: US 6,876,333 B2
(45) Date of Patent: Apr. 5, 2005

(54) BUILT-IN ANTENNA CONFIGURATION

(75) Inventor: Churng-Jou Tasi, Tainan Hsien (TW)

(73) Assignee: Churng-Jou Tsai, Tainan Hsien (TW)

( * ) Notice: Subject to any disclaimer, the term of this patent is extended or adjusted under 35 U.S.C. 154(b) by 6 days.

(21) Appl. No.: 10/613,415

(22) Filed: Jul. 3, 2003

(65) Prior Publication Data

US 2005/0001766 A1 Jan. 6, 2005

(51) Int. Cl.[7] ..... H01Q 1/24; H01Q 1/38
(52) U.S. Cl. ..... 343/702; 343/700 MS
(58) Field of Search ..... 343/702, 700 MS, 343/846, 848, 841

(56) References Cited

U.S. PATENT DOCUMENTS 4,924,237 A * 5/1990 Honda et al. ..... 343/702
4,980,694 A * 12/1990 Hines ..... 343/702
6,184,834 B1 * 2/2001 Utsumi et al. ..... 343/702
6,539,207 B1 * 3/2003 del Castillo et al. ..... 455/90.3

* cited by examiner

*Primary Examiner*—Tan Ho

(57) ABSTRACT

A built-in antenna configuration uses a metal frame or metal shell of an electronic communication product as the ground end of the antenna. The ground end connects fixedly a signal end to form a built-in antenna configuration, in which the ground end is substantially parallel to the signal end. The built-in antenna configuration without a ground end can effectively reduce the internal occupation space of an electronic communication product relative to a conventional antenna with a ground end. The built-in antenna configuration can indeed make an electronic communication product reach the requirement of a miniature, meet the appeals of easily stowing and conveniently carrying, reduce the manufacturing cost thereof and thus promote the product competition and the added value thereof.

3 Claims, 5 Drawing Sheets

BUILT-IN ANTENNA CONFIGURATION

BACKGROUND OF THE INVENTION

1. Field of the Invention

The present invention relates to an antenna configuration, and in particular to a built-in antenna configuration using a metal frame or metal shell of an electronic communication product as the ground end of the antenna. Therefore this antenna does not need to provide with a ground end.

2. The Related Art

The configuration of a conventional dipole antenna is to respectively connect the positive and negative electrodes, or the signal and ground ends thereof to a coaxial feeder. In manufacturing, the signal end and the ground end shall be provided. FIG. 1 shows a conventional single frequency antenna, Planer Inverted F Antenna (PIFA), the signal end 41 and the ground end 42 thereof respectively connected to a coaxial feeder 43. In general, the area of the ground end 42 thereof is far greater than that of the signal end 41.

The defects of the conventional single frequency antenna are the following:

(1) Due to a larger area of the ground end 42, when the antenna is installed in the limited internal space of an electronic communication product for example notebook computer, the ground end 42 occupies quite a few of internal space, which results in the arrangement difficulty of other electronic component parts.

(2) In the assembly process, the larger area of the ground end 42 results in the limitation of assembly space, inconvenience in assembly and assembly efficiency reduction of other electronic component parts of the electronic communication product.

(3) Or it is needed to enlarge the size thereof, which is unfavorable to the appeal of a miniature.

To solve the above-mentioned problem on the ground end of a conventional antenna, another antenna is proposed. The larger area of the ground end of the conventional antenna is changed to a strip configuration shown in FIG. 2. The antenna configuration comprises a signal end 51, a ground end 52 and a coaxial feeder 53, in which the ground end 52 is of a strip. The strip ground end 52 replaces the larger rectangular area of the ground end 52 to facilitate the interior arrangement and the assembly of component parts of an electronic communication product. This antenna slightly improves the defects of the above-mentioned conventional antenna. However the antenna still has the following defects:

(1) Due to the strip ground end 52 still having a larger area, it occupies quite a few of internal space of a small electronic communication product and thus hinder the arrangement of other electronic component parts.

(2) In the assembly process, the strip ground end 52 also limits the assembling work of other component parts of an electronic communication product and thus results in the production efficiency thereof not able to be raised and the production cost thereof not able to be reduced.

(3) Although to enlarge the size of the product is not needed, it is still unfavorable to the appeal of a miniature.

In view of the defects in the configuration and manufacturing of the conventional antennas, the present invention provides with a built-in antenna configuration using a metal frame or metal shell of an electronic communication product as a ground end. The antenna without a ground end in accordance with the present invention indeed makes an electronic communication product reach the requirement of a miniature and meet the appeals of easily stowing and conveniently carrying.

SUMMARY OF THE INVENTION

The present invention relates to a built-in antenna configuration, which uses a metal frame or metal shell of an electronic communication product as the ground end of an antenna. The ground end connects fixedly a signal end to form a built-in antenna configuration, in which the ground end is substantially parallel to the signal end.

An object of the present invention is to provide a built-in antenna configuration using a metal frame or metal shell of an electronic communication product as the ground end of the antenna. Although the antenna is not provided with a ground end, it still has a basic configuration of PIFA to receive and transmit signals. Due to requiring no ground end, the antenna can effectively reach the requirement of being installed in an electronic communication product with a narrow internal space.

A second object of the present invention is to provide a built-in antenna configuration without a ground end, which can make an electronic communication product reach a miniature and meet the appeals of easily stowing and conveniently carrying.

Another object of the present invention is to provide a built-in antenna configuration without a ground end, which can increase the convenience and efficiency of the assembly of component parts, reduce the manufacturing cost thereof and thus promote the product competition and the added value thereof.

The objects, advantageous features and effectiveness of the present invention will be apparent to those skilled in the art after reading the detailed description of the preferred embodiments thereof in reference to the accompanying drawings, in which:

DETAILED DESCRIPTION OF THE PREFERRED EMBODIMENTS

Figure 1:
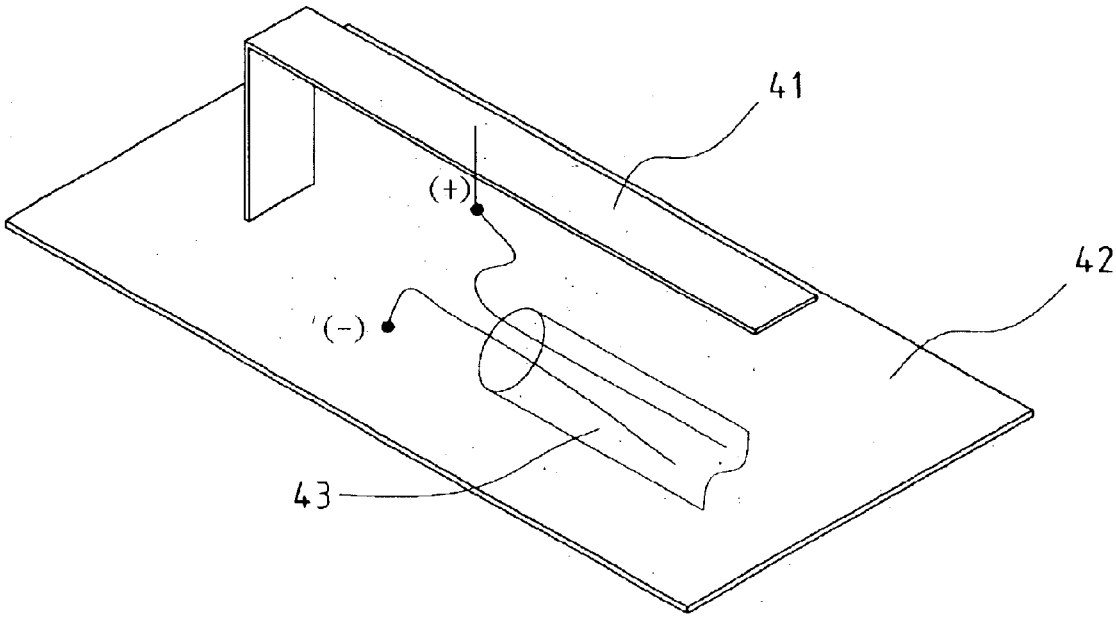
FIG. 1 (PRIOR ART)
FIG. 1 is a schematic view of a conventional antenna configuration.
Figure 2:
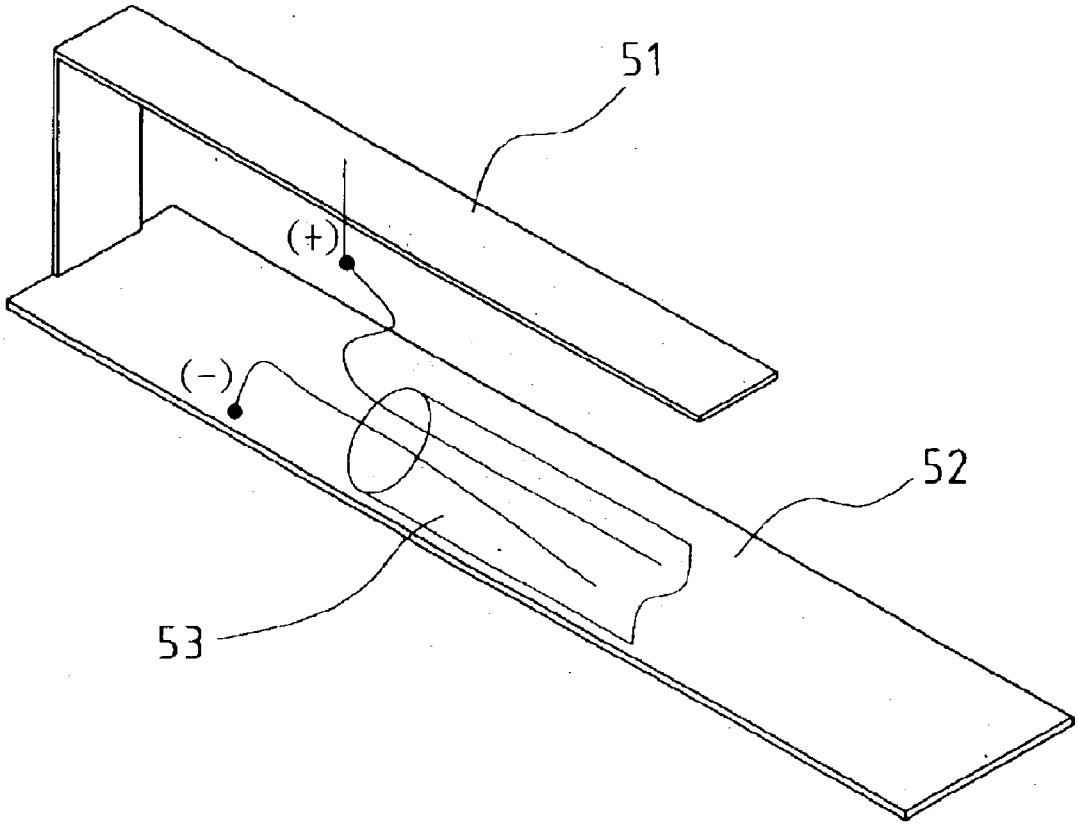
FIG. 2 (PRIOR ART)
FIG. 2 is a schematic view of another conventional antenna configuration.
Figure 3:
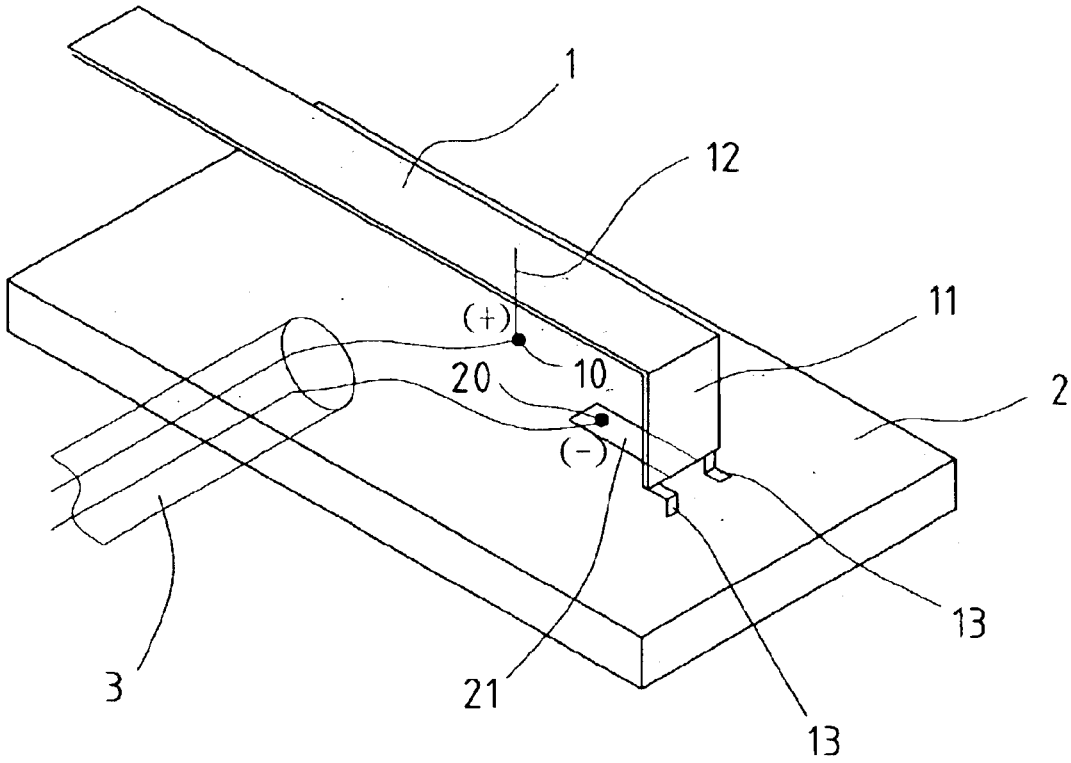
FIG. 3 is a schematic configuration view of a preferred embodiment in accordance with the present invention.
Figure 4:
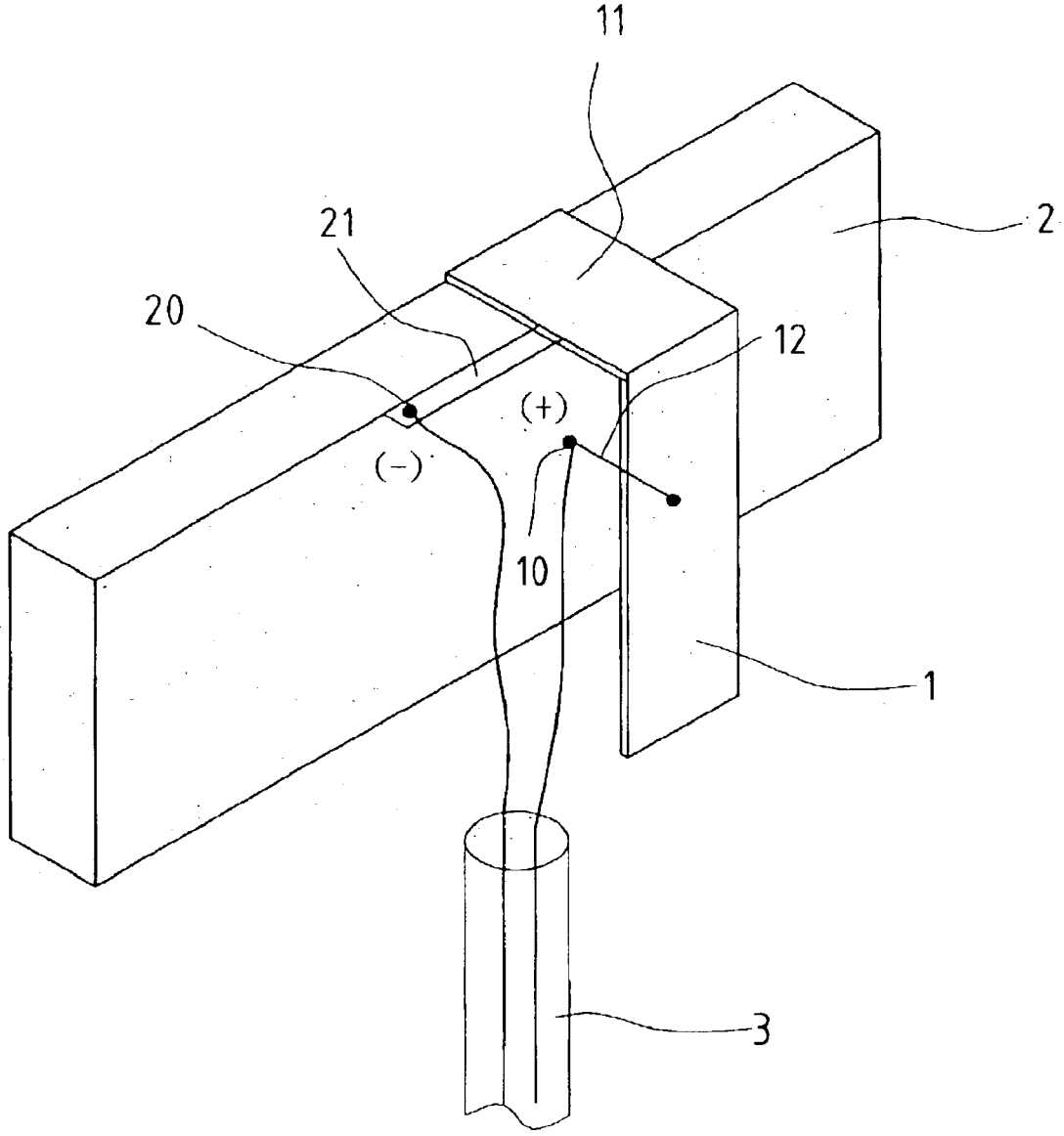
FIG. 4 is a schematic configuration view of another preferred embodiment in accordance with the present invention.

Referring to FIGS. 3 and 4, a built-in antenna configuration in accordance with the present invention comprises a signal end 1 and a ground end 2. The improvements of the present invention comprise: a metal frame or metal shell of an electronic communication product being used as the ground end 2; the ground end 2 connecting fixedly the signal end 1 respectively connected to the negative and the positive electrodes of a coaxial feeder 3 to form a built-in antenna configuration; and the ground end 2 being substantially parallel to the signal end 1.

FIG. 3 is a built-in antenna configuration of a preferred embodiment in accordance with the present invention. The signal end 1 is of a strip plate. An end of the signal end 1 is bended and folded to an angle, about 90°, to form a fixing end 11. The signal end 1 connects a conductor 12 provided on the end thereof with a positive electrode feed-in point 10. The ground end 2 is a conductive metal frame originally mounted in an electronic communication device.

In assembling, both sides at the bottom of the fixing end 11 of the signal end 1 fixedly connect a substantially L-shaped metal fixing foot 13 for being fixed on the ground end 2. The bottom of the fixing end 11 is connected with a conducting plate 21 provided on the end thereof with a negative electrode feed-in point 20. The conducting plate 21 is substantially parallel to the signal end 1; and the ground end 2 is also substantially parallel to the signal end 1. The positive and negative electrode feed-in points 10, 20 thereof are respectively connected to a coaxial feeder 3 to form a built-in antenna configuration.

FIG. 4 is a built-in antenna configuration of another preferred embodiment in accordance with the present invention. The signal end 1 is of a strip plate. An end of the signal end 1 is bended and folded to an angle, about 90°, to form a fixing end 11. The signal end 1 connects a conductor 12 provided on the end thereof with a positive electrode feed-in point 10. The ground end 2 is a conductive metal frame originally mounted in an electronic communication device.

In assembling, the fixing end 11 of the signal end 1 is fixedly connected to a side of the ground end 2. The side of the fixing end 11 connects a conducting plate 21 connected in parallel with the ground end 2. The conducting plate 21 is provided with a negative electrode feed-in point 20. The conducting plate 21 is substantially parallel to the signal end 1; and the ground end 2 is also substantially parallel to the signal end 1. The positive and negative electrode feed-in points 10, 20 thereof are respectively connected to a coaxial feeder 3 to form a built-in antenna configuration.

Figure 5:
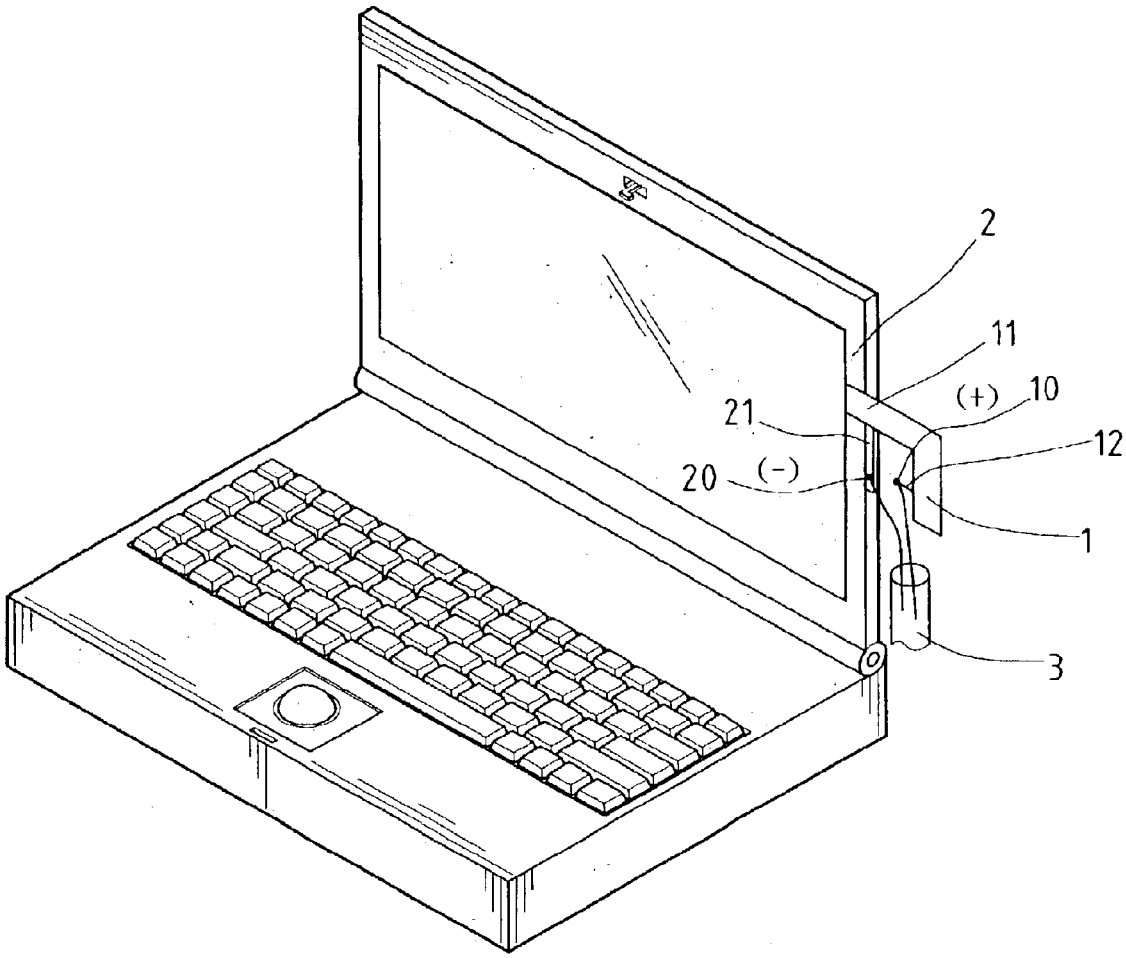
FIG. 5 shows a schematic view of a preferred embodiment of the present invention installed in a notebook computer.

FIG. 5 shows a preferred embodiment of the present invention installed in a notebook computer. The signal end 1 is of a L-shaped plate. The tail end of the L-shaped signal end 1 is a fixing end 11. The signal end 1 connects a conductor 12 provided on the end thereof a positive electrode feed-in point 10. The ground end 2 is a metal frame supporting the LCD screen.

In assembling, the fixing end 11 of the L-shaped signal end 1 is fixed to the ground end 2. A side of the fixing end 11 is provided with a conducting plate 21 connected in parallel with a side of the ground end 2. The conducting plate 21 is provided with a negative electrode feed-in point 20. The conducting plate 21 is substantially parallel to the signal end 1; and the ground end 2 is also substantially parallel to the signal end 1. The positive and negative electrode feed-in points 10, 20 are respectively connected to a coaxial feeder 3 to form a built-in antenna configuration.

The above statements are only for illustrating the preferred embodiments of the present invention, and not for giving any limitation to the scope of the present invention. It will be apparent to those skilled in this art that all equivalent modifications and changes shall fall within the scope of the appended claims and are intended to form part of this invention.

What is claimed is:

1. A built-in antenna configuration comprising a signal end and a ground end; and improvement comprising:

a metal frame or metal shell of an electronic communication device being used as the ground end;

the ground end connecting fixedly the signal end respectively connected to the negative and the positive electrodes of a coaxial feeder to form a built-in antenna configuration; and the ground end being substantially parallel to the signal end, wherein:

the signal end is of a strip plate;

an end of the signal end is bended and folded to an angle, about 90°, to form a fixing end;

the signal end connects a conductor provided on the end thereof with a positive electrode feed-in point;

the ground end is a conductive metal frame originally mounted in an electronic communication device;

in assembling, both sides at the bottom of the fixing end of the signal end fixedly connect a metal fixing foot for being fixed on the ground end;

the bottom of the fixing end is connected with a conducting plate provided on the end thereof with a negative electrode feed-in point;

the conducting plate is substantially parallel to the signal end, and the ground end is also substantially parallel to the signal end; and the positive and negative electrode feed-in points thereof are respectively connected to a coaxial feeder.

2. A built-in antenna configuration comprising a signal end and a ground end; and improvement comprising:

a metal frame or a metal shell of an electronic communication device being used as the ground end;

the ground end connecting fixedly the signal end respectively connected to the negative and the positive electrodes of a coaxial feeder to form a built-in antenna configuration; and the ground end being substantially parallel to the signal end, wherein:

the signal end is of a strip plate;

an end of the signal end is bended and folded to an angle, about 90°, to form a fixing end;

the signal end connects to a conductor provided on the end thereof with a positive electrode feed-in point;

the ground end is a conductive metal frame originally mounted in an electronic communication device;

in assembling, the fixing end of the signal end is fixedly connected to a side of the side of the ground end;

the side of the fixing end connects a conducting plate connected in parallel with the ground end;

the conducting plate is provided with a negative electrode feed-in point;

the conducting plate is substantially parallel to the signal end; and the positive and negative electrode feed-in points thereof are respectively connected to a coaxial feed.

3. A built-in antenna configuration comprising a signal end and a ground end; and improvement comprising:

a metal frame or a metal shell of an electronic communication device being used as the ground end;

the ground end connecting fixedly the signal end respectively connected to the negative and the positive electrodes of a coaxial feeder to form a built-in antenna configuration; and the ground end being substantially parallel to the signal end, wherein:

the signal end is of a L-shaped plate;

the tail end of the L-shaped signal end is a fixing end;

the signal end connects a conductor provided on the end thereof with a positive electrode feed-in point;

the ground end is a metal frame supporting the LCD screen;

in assembling, the fixing end of the L-shaped signal end is fixed to the ground end;

a side of the fixing end is provided with a conducting plate connected in parallel with a side of the ground end;

the conducting plate is provided with a negative electrode feed-in point;

the conducting plate is substantially parallel to the signal end, and the ground end is also substantially parallel to the signal end; and the positive and negative electrode feed-in points are respectively connected to a coaxial feeder.

* * * * *